United States Patent [19]

Yasui

[11] Patent Number: 4,611,936

[45] **Date of Patent: * Sep. 16, 1986**

[54] THERMAL PRINTER

[75] Inventor: Tsuneo Yasui, Nagoya, Japan

[73] Assignee: Brother Kogyo Kabushiki Kaisha, Nagoya, Japan

[ * ] Notice: The portion of the term of this patent subsequent to May 7, 2002 has been disclaimed.

[21] Appl. No.: 738,900

[22] Filed: May 29, 1985

Related U.S. Application Data

[63] Continuation of Ser. No. 569,195, Jan. 9, 1984, abandoned.

[30] Foreign Application Priority Data

Jan. 26, 1983 [JP] Japan ..... 58-10918

[51] Int. Cl.[4] ..... B41J 3/20

[52] U.S. Cl. ..... 400/120; 400/208; 346/76 PH

[58] Field of Search ..... 400/61, 76, 120, 196, 400/196.1, 207, 208, 208.1, 249, 323; 219/216 PH; 346/76 PH

[56] References Cited

U.S. PATENT DOCUMENTS

| | | | |
|---|---|---|---|
| 2,873,015 | 2/1959 | Gray | 400/208.1 |
| 3,989,131 | 11/1976 | Knirsch et al. | 346/76 PH X |
| 4,134,696 | 1/1979 | Harakata et al. | 400/323 |
| 4,387,380 | 6/1983 | Asakura et al. | 346/76 PH |
| 4,516,137 | 5/1985 | Yasui | 346/76 PH |

FOREIGN PATENT DOCUMENTS

| | | | |
|---|---|---|---|
| 74181 | 5/1982 | Japan | 400/249 |

*Primary Examiner*—Charles A. Pearson
*Attorney, Agent, or Firm*—Moonray Kojima

[57] ABSTRACT

A thermal printer is provided with a detecting member adapted to detect the presence of a thermal ribbon cassette on the printer. When the thermal ribbon cassette is mounted on the printer, the thermal print head is held at a release position until a cycle of ribbon feeding action has been completed. The thermal head is moved from the release position to a print position to print data on the next line, after the used part of the thermal ribbon has been taken up and an unused part of the thermal ribbon is positioned opposite a sheet of ordinary paper.

1 Claim, 6 Drawing Figures

FIG. 4B

| ITEM | INSTRUCTIONS |
|---|---|
| A | START PRINTING ROUTINE |
| S1 | PRINTING DIRECTION? |
| S2 | PRINT ONE CHARACTER (LEFT TO RIGHT) |
| S3 | HAS DATA FOR ONE PRINTING LINE BEEN PRINTED? |
| S4 | PRINT ONE CHARACTER (RIGHT TO LEFT) |
| S5 | HAS DATA FOR ONE PRINTING LINE BEEN PRINTED? |
| S6 | OUTPUT OF HEAD RELEASE SIGNAL |
| S7 | IS MICROSWITCH ON? |
| S8 | OUTPUT OF RIBBON FEED CONTROL SIGNAL |
| S10 | HAS RIBBON TAKE-UP BEEN COMPLETED? |
| S11 | RIBBON FEED CONTROL SIGNAL OFF |
| S12 | OUTPUT OF SHEET FEED SIGNAL |
| S13 | HAS SHEET FEED BEEN COMPLETED? |
| S14 | SHEET FEED CONTROL SIGNAL OFF |
| S15 | HEAD RELEASE SIGNAL |
| E | END |

THERMAL PRINTER

This is a continuation of application Ser. No. 569,195, filed Jan. 9, 1984, now abandoned.

BACKGROUND OF THE INVENTION

1. Field of Invention

This invention relates to a thermal printer having a thermal print head which effects printing operation through heat transfer.

2. Discussion of Prior Art

In a commonly known thermal printer which prints on sheets of ordinary paper, i.e. non-heat sensitive paper, printing operation is achieved by a thermal print head acting through a thermal ribbon (accommodated in a cassette) having a thermally transferable ink layer. In such thermal printer, the thermal head is moved for printing along a paper supporting platen while it is held in pressed contact, via the thermal ribbon, with the printing surface of the paper placed on the platen. Consequently, relative movement between the paper and the thermal ribbon causes friction between the ink layer of the ribbon and the printing surface of the paper sheet, thus resulting in undesired placement of ink on the printing surface of the paper. For this reason, thermal printing is effected without such relative movement of the thermal ribbon with the paper.

Accordingly, bidirectional printing is easy when the thermal head prints directly on a sheet of thermosensitive paper without the use of any thermal ribbon. However, on the other hand, it has been found that bidirectional printing on a sheet of ordinary paper using a thermal head and a thermal ribbon is difficult because of problems involving construction of the thermal ribbon supporting mechanism and of the thermal ribbon feeding mechanism. Consequently, printing operation using a thermal ribbon has been limited to printing in a single fixed direction, and hence, increase in printing speed is almost impossible.

SUMMARY OF THE INVENTION

Accordingly, an object of the invention is to overcome the aforementioned and other deficiencies and disadvantages of the prior art.

Another object is to provide a thermal printer capable of bidirectional printing, either.in printing on a sheet of thermal sensitive paper or, in the alternative, in printing on a sheet of ordinary paper by use of a thermal ribbon.

A further object is to provide a thermal printer capable of being changed automatically into a bidirectional printing mode using a thermal ribbon when the thermal ribbon is mounted thereon.

The foregoing and other objects of the invention are attained in a thermal printer which is capable of performing bidirectional printing operation through a thermal sensitive printing ribbon, and which comprises a thermal ribbon cassette mounted on the frame of a thermal printer, means for reciprocating the thermal print head along the platen for bidirectional printing pperation, paper feed means for feeding a paper supported on the platen, detecting means for sensing the presence of the thermal ribbon at a predetermined position to determine whether the thermal ribbon is usable or not, with the detecting means generating a signal according to the presence or absence of the thermal ribbon at the predetermined position, head release means for moving the thermal print head from a printing position where the thermal head is placed directly in contact with a sheet of thermal paper, or, in the alternative, indirectly through the thermal ribbon in contact with a sheet of ordinary paper, to a release position where the thermal head is released away from the sheet of ordinary paper or thermal paper, ribbon feed means for feeding the thermal ribbon suitably so that an unused part of the thermal ribbon is positioned opposite the sheet of ordinary paper, memory means for temporarily storing print data given thereto by an external device and corresponding to at least the information of one printing line, drive means for actuating the head releasing means so as to move the thermal head from the printing position to the released position upon the completion of the printing, responsive to the printing data corresponding to the information of one printing line, and actuating the paper feed means to feed the paper by a predetermined feed length, and wherein the drive means has control means which controls the head release means so as to hold the thermal print head at the release position after the completion of the printing, responsive to the print data corresponding to information of one printing line, at least until the completion of the paper feeding action of the paper feed means when the absence of thermal ribbon is detected by the detecting means, or which actuates the ribbon feed means and controls the head release means so as to hold the thermal print head at the release position at least until the completion of the ribbon feeding action of the ribbon feed means when the presence of the thermal ribbon is detected by the detecting means.

BRIEF DESCRIPTION OF DRAWINGS

FIGS. 4A and 4B are flow chart and table, respectively, depciting a routine for controlling the operation of the embodiment.

DETAILED DESCRIPTION OF PREFERRED EMBODIMENTS

Figure 1:
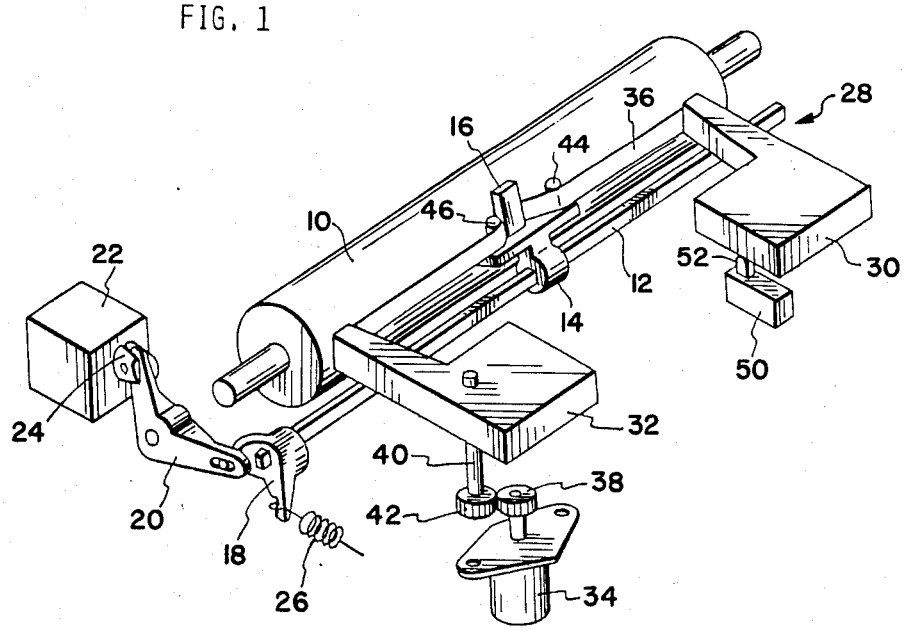
FIG. 1 is a perspective view depicting an illustrative embodiment of the invention.

Turning to FIG. 1, an illustrative embodiment is depicted showing only the essential elements of a thermal printer. The printer comprises a platen 10 supported rotatably at shafts extending from opposite ends thereof on a frame, not shown, of the printer, and adapted to be driven for rotation by a paper feed motor , not shown . A guide bar 12, for example, of a rectangular cross section, is disposed in parallel to platen 10. A carriage 14 is supported slidably on guide bar 12. A thermal head 16, namely a printing head, is mounted on carriage 14. Thermal head 16 moves along a printing line on platen 10 as carriage 14 is moved along guide bar 12 by a carriage driving motor, not shown.

Guide bar 12 is rotatably supported on a frame, not shown. A lever 18 fixed to one end of guide bar 12 is connected through another lever 20 to a plunger 24 of an electromagnet 22. Lever 18 is biased counterclockwise (as viewed in FIG. 1) by a spring 26. Thus, thermal head 16 is held normally in contact with platen 10. When electromagnet 22 is energized, plunger 24 is retracted, lever 20 is rotated counterclockwise, and lever 18 is rotated clockwise, thereby to cause thermal head 16 to be released away from platen 10 against the biasing force of spring 26.

A printing ribbon device 28 is provided adjacent to platen 10. The printing ribbon device 28 comprises a ribbon feed cassette 30, a ribbon take-up cassette 32 and a ribbon feed motor 34. Ribbon feed cassette 30 and ribbon take-up cassette 32 are replaceable and are supported on a frame, not shown, of the printer. A thermal ribbon 36, naving a thermally transferable ink layer, drawn out from ribbon feed cassette 30 is extended along the longitudinal direction of platen 10 and is taken up by ribbon take-up cassette 32. Thus, in this embodiment, ribbon feed cassette 30 constitutes a ribbon feed unit, while the ribbon take-up cassette 32 constitutes the ribbon take-up unit of the printer. Ribbon feed motor 34 is secured to a frame, not shown, and rotates a feed roller and a ribbon take-up spool provided within ribbon take-up cassette 32 by rotating a ribbon feed shaft 40 journaled on a frame through a gear 38 fixed to the output shaft of feed motor 34 and engaging a gear 42 fixed to ribbon feed shaft 40 to feed thermal ribbon 36 by a fixed length and to take-up the printing ribbon simultaneously on the take-up spool.

In this embodiment, ribbon feed motor 34, gears 38 and 42, ribbon feed shaft 40 and the feed roller provided within ribbon takeup cassette 32 constitute a ribbon feed mechanism. Thermal ribbon 36, extending between ribbon feed cassette 30 and ribbon take-up cassette 32 is guided by ribbon guides 44 and 46 supported rotatably on carriage 14 so as to be extended and moved through the space between thermal head 16 and platen 10.

Figure 2A:
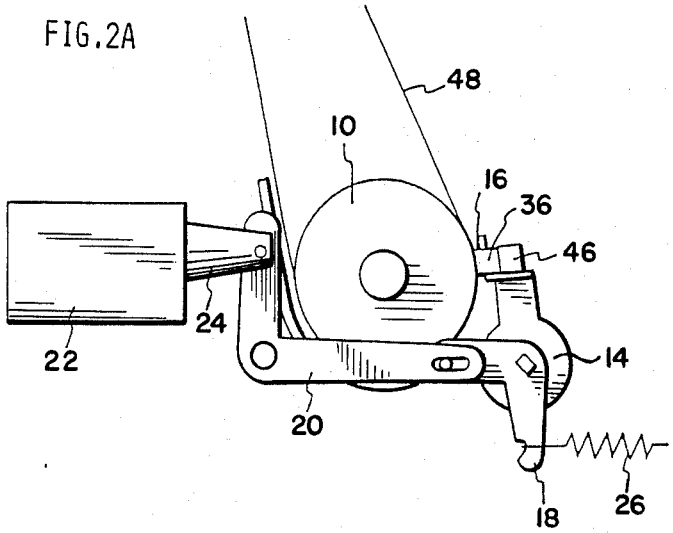
FIG. 2A is an enlarged sectional view depicting a thermal print head in a printing position.
Figure 2B:
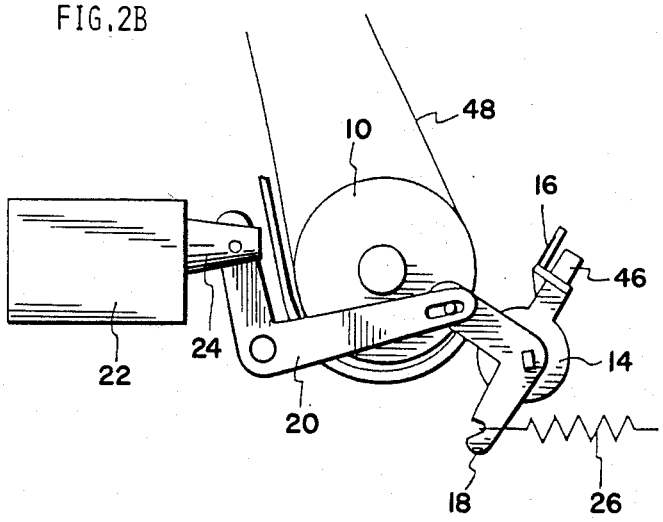
FIG. 2B is an enlarged sectional view depicting a thermal print head in a released position.

Normally, thermal print head 16 is pressed against ordinary paper through thermal ribbon 36 as illustrated in FIG. 2A. When head releasing electromagnet 22 is energized to retract plunger 24, lever 20 is moved counterclockwise, lever 18 is moved clockwise, thereby to move clockwise head 16 and release away head 16 from paper 48 against the bias force of spring 26, as illustrated in FIG. 2B.

A microswitch 50 (see FIG. 1), employed as a detecting means, is secured to the frame, not shown, supporting ribbon feed cassette 30 so that actuator 52 thereof is depressed when ribbon feed cassette 30 is mounted in place. When actuator 52 is depressed, microswitch 50 sends a signal representing an ordinary paper printing mode, in which printing on an ordinary paper 48, using a thermal ribbon is performed, to a central processing unit (CPU) 54 (see FIG. 3).

Figure 3:
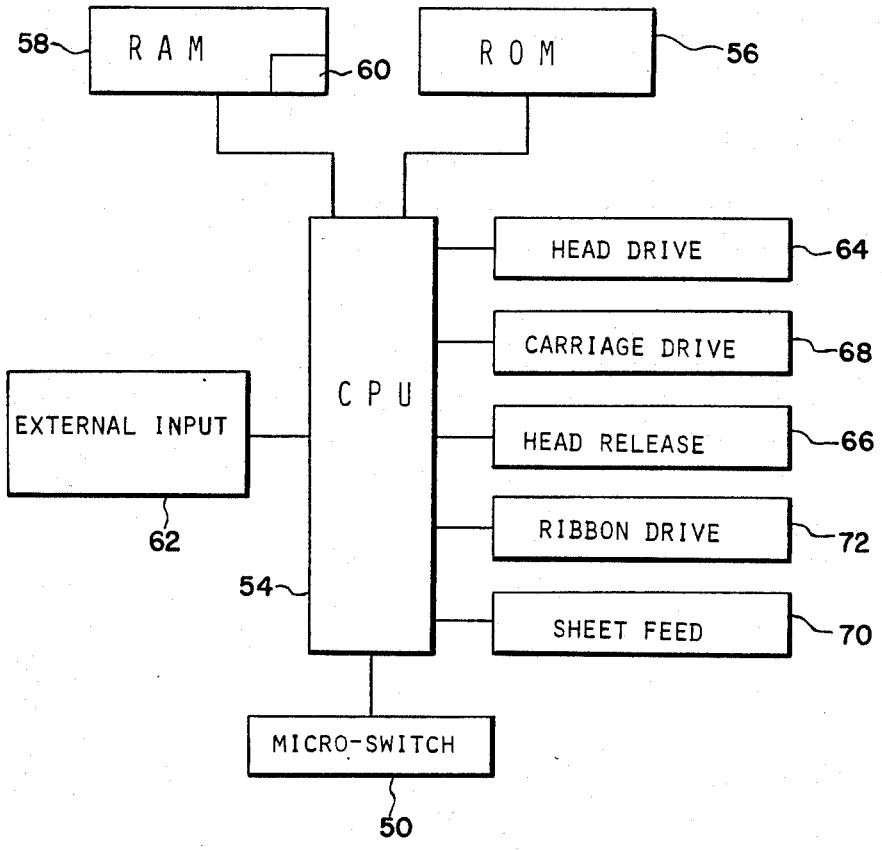
FIG. 3 is a block diagram depicting circuits and devices used to operate the embodiment.

The printer comprising the above discussed mechanisms is controlled by an electronic circuit, such as depicted as block diagrams in FIG. 3. A CPU 54, a read only memory (ROM) 56 and a random access memory (RAM) 58 constitute a microcomputer. The ROM 56 stores a fixed program for the operation of the printer. The RAM 58 is provided with a buffer memory 60.

The buffer memory 60 stores temporarily printing data corresponding to printing information of one line of printing and in a printer adapted to print, for example, 80 characters in one printing line, memory 60 is provided with addresses from the first address 4001 to the last address 4080.

Connected to CPU 54 is an external input unit 62 for supplying printing data to the printer, namely, character codes and symbolic codes representing characters and symbols, respectively, to be printed and space codes representing spaces. CPU 54 is connected further to a print head driving unit 64, head release unit 66, carriage driving unit 68, sheet feeding unit 70, and ribbon driving unit 72, each of whose functions are self-explanatory.

The operation of the printer will now be described with reference to the flow cnart of FIG. 4A and the corresponding table of instructions in FIG. 4B, both which figures are to be taken together.

In this illustrative embodiment, buffer memory 60 of RAM 58 is cleared upon connection of the printer to a power source. When a print start command is given by input unit 62, CPU 54 reads out the printing data to be printed in the first printing line from among printing data which have previously been stored in input unit 62, according to a program stored in ROM 56, and transfers the printing data to buffer memory 60 to actuate head driving unit 64 and carriage driving unit 68 according to the transferred printing data, for printing the printing data of the first printing line.

Figure 4A:
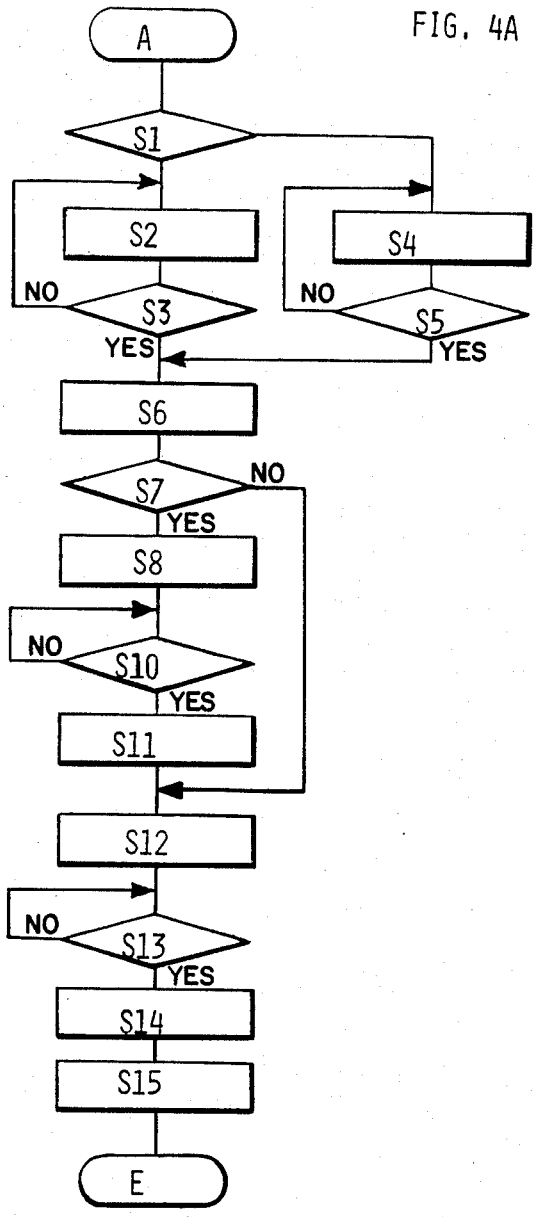

In step S1 (see FIG. 4A) CPU 54 decides which of forward printing or backward printing, is required to be carried out (see FIG. 4B). When forward printing is required to be carried out, the program proceeds to step S2, where one character is printed on the basis of the printing data. Then, carriage 14 is moved from left to right, and then the program proceeds to step S3. In step S3, CPU 54 decides whether or not all the printing data stored in the buffer memory has been printed out. If all the printing data has not yet been read out, the program returns to step S2. Then, steps S2 and S3 are repeated alternately until all the printing data has been printed out.

On the other hand, in case backward printing is required to be carried out in step S1, the program proceeds to step S4, wherein one character is printed out. Then, carriage 14 is moved from right to left. Then, the program proceeds to step S5. In step S5, CPU 54 executes the same decision making operation as in step S3. Step S4 and step S5 are repeated alternately until the backward printing of the printing data corresponding to one line has been completed.

Upon the completion of the printing of the printing data corresponding to one printing line in Step S3 or in step S5, the program proceeds to step S6, wherein a head release signal is given to actuate head releasing unit 66, in order to move the thermal print head 16 to the release position.

In step S7, CPU 54 decides whether or not microswitch 50 is in an ON state. As shown in FIGS. 1 and 2A, 2B, microswitch 50 is in an ON state when ribbon feed cassette 30 is mounted on the frame in place and thermal ribbon 36 is extended.

When microswitch 50 is in an ON state, the program proceeds to step S8, and Step S10, sequentially, to actuate the ribbon driving unit 72, so that part of thermal ribbon 36 which has been used for printing the above-mentioned printing data corresponding to one printing line is taken up by ribbon take-up cassette 32 and an unused part of the thermal ribbon is drawn out from ribbon feed cassette 30. Upon the decision of the completion of the ribbon feed action in step S10, the program proceeds to step S11, wherein the driving action of ribbon driving unit 72 is interrupted. Then, the program proceeds to step S12, wherein the paper feed unit 70 is actuated to execute paper feeding action.

On the other hand, in case a decision is made that the microswitch 50 is in an OFF state in step S7, that is, in case no thermal ribbon 36 is provided, step S8, step S10 and step S11 are skipped and the program proceeds to step S12 so that the paper feeding action is executed.

Then, the program proceeds to step S13, wherein a decision is made whether the paper feeding action has been completed or not. In case the paper feeding action has been completed, the program proceeds to step S14, wherein the paper feeding operation of sheet feeding unit 70 is interrupted. If not, the sheet feeding action is continued. After the paper feeding action of the sheet feeding unit 70 has been interrupted in step S14, the program proceeds to step S15, wherein the head release signal is interrupted, to move thermal print head 16 from the release position to the printing position.

Thus, thermal print head 16 is held at the release position until the ribbon feeding action and the paper feeding action have been completed, when a thermal ribbon 36 is provided.

On the other hand, thermal head 16 is held at the release position until the paper feeding action has been completed, when no thermal ribbon 36 is provided, that is, when thermal paper is used.

The printing operation for one printing line is completed and preparation for printing the next line is accomplished through instructions of steps S1 through S15. Then, printing operation for the next printing line is executed on the basis of the next printing data, through the same steps. Advantageously, because of the unique manner of holding the head in a released position during certain instructions, bidirectional printing is simply and easily accomplished for both the instance wherein thermal paper and thermal head is used, and wherein thermal head and ordinary paper and thermal ribbon is used.

The foregoing description is illustrative of the principles of the invention. Numerous modifications and extensions thereof would be apparent to the worker skilled in the art. All such modifications and extensions are to be considered to be within the spirit and scope of the invention.

What is claimed is:

1. A thermal printer capable of printing with a thermal print head which moves along a platen on a sheet of ordinary paper through a thermal ribbon having a thermally transferable ink layer, and also capable of printing with a thermal print head directly on a sheet of thermal paper without using said thermal ribbon; said thermal printer comprising means for reciprocally moving said thermal head along said platen for bidirectional printing operation in both modes when said thermal ribbon is used and also when said thermal ribbon is not used;

paper feed means for feeding a paper supported on said platen, said paper being either said sheet of ordinary paper or said sheet of thermal paper;

a pair of ribbon holders;

detecting means comprising a microswitch actuatable by at least one of said pair of ribbon holders, for sensing presence and absence of said thermal ribbon to determine whether said thermal ribbon is available to be used or not to be used in printing operation, said detecting means generating a signal according to the presence and absence of said thermal ribbon;

head release means for moving said thermal print head from a printing position whereat said thermal head is placed directly in contact with said sheet of thermal paper, and alternatively, indirectly through said thermal ribbon in contact with said sheet of ordinary paper, to a release position whereat said thermal head is released away from said sheet of thermal paper or away from said thermal ribbon and said sheet of orginary paper;

ribbon feeding means responsive to said detecting means detecting presence of said thermal ribbon for feeding said thermal ribbon from one of said pair of ribbon holders to the other of said pair of ribbon holders so that an unused part of said thermal ribbon is located opposite to and between said thermal head and said sheet of ordinary paper;

memory means for temporarily storing print data for one printing line;

drive mean for actuating said head releasing means to move said thermal head from said printing position to said release position, upon completion of printing operation for one printing line, said paper feed means being thereafter actuated to feed by a predetermined length said sheet of thermal paper and, alternatively, said sheet or ordinary paper; and control means actuated by a signal from said detecting means indicating absence of said thermal ribbon for controlling said drive means to cause said head release means to hold said thermal head at said release position after completion of printing operation for one printing line for a first predetermined period of time until said paper feed means completes thermal paper feed action without an operation of said ribbon feeding means; said control means actuated by a signal from said detecting means indicating presence of said thermal ribbon for controlling said drive means to cause said head release means to hold said thermal head at said release position after completion of printing operation for one printing line for a second predetermined period of time until said paper feed means completes ordinary paper feed action and said ribbon feed means completes thermal ribbon feed action, said ordinary paper feed action and said ribbon feed action occurring sequentially.

* * * * *